US007909905B2

(12) United States Patent
Tokunaga

(10) Patent No.: US 7,909,905 B2
(45) Date of Patent: Mar. 22, 2011

(54) TICN-BASE CERMET AND CUTTING TOOL AND METHOD FOR MANUFACTURING CUT ARTICLE USING THE SAME

(75) Inventor: Takashi Tokunaga, Satsumasendai (JP)

(73) Assignee: Kyocera Corporation, Kyoto (JP)

( * ) Notice: Subject to any disclaimer, the term of this patent is extended or adjusted under 35 U.S.C. 154(b) by 709 days.

(21) Appl. No.: 11/854,743

(22) Filed: Sep. 13, 2007

(65) Prior Publication Data

US 2008/0016985 A1 Jan. 24, 2008

Related U.S. Application Data

(63) Continuation-in-part of application No. PCT/JP2006/304714, filed on Mar. 10, 2006.

(30) Foreign Application Priority Data

Mar. 18, 2005 (JP) ..... 2005-078493

(51) Int. Cl.
*C22C 29/04* (2006.01)
*B23P 15/28* (2006.01)

(52) U.S. Cl. ..... 75/238; 407/119; 51/309

(58) Field of Classification Search ..... 75/238
See application file for complete search history.

(56) References Cited

U.S. PATENT DOCUMENTS

| | | | | |
|---|---|---|---|---|
| 5,395,421 | A * | 3/1995 | Weinl et al. | 75/238 |
| 5,766,742 | A * | 6/1998 | Nakamura et al. | 428/210 |
| 6,231,277 | B1 * | 5/2001 | Abukawa | 407/119 |

FOREIGN PATENT DOCUMENTS

| | | |
|---|---|---|
| JP | 02-254131 | 10/1990 |
| JP | 03-170637 | 7/1991 |
| JP | 10-287946 | 10/1998 |
| JP | 11-229068 | 8/1999 |
| JP | 2001-152276 | 6/2001 |

* cited by examiner

*Primary Examiner* — Roy King
*Assistant Examiner* — Ngoclan T Mai
(74) *Attorney, Agent, or Firm* — Volpe and Koenig, PC

(57) ABSTRACT

A cermet comprises a binding phase made of a binding metal including Co and/or Ni. The binding phase is 5 to 30 mass %. The cermet further comprises a plurality of hard particles bound each other with the binding phase. The hard particles comprise core-containing structure particles having cores and shells both including TiCN. The core-containing structure particles comprise first core-containing structure particles of which shells contain the binding metal and second core-containing structure particles of which cores and shells both contain the binding metal.

10 Claims, 2 Drawing Sheets

TICN-BASE CERMET AND CUTTING TOOL AND METHOD FOR MANUFACTURING CUT ARTICLE USING THE SAME

CROSS REFERENCE TO RELATED APPLICATION

The present application claims priority under 35 U.S.C. §120 to PCT Application No. PCT/JP2006/304714, filed on Mar. 10, 2006, entitled "TiCN BASE CERMET AND CUTTING TOOL AND METHOD FOR MANUFACTURING CUT ARTICLE USING THE SAME." The contents of this application are incorporated herein by reference in their entirety.

FIELD OF INVENTION

The present invention relates to a TiCN-base cermet having satisfactory toughness and hardness as, for example, a cutting tool material or a wear-resistant tool material and relates to a cutting tool made of the TiCN-base cermet. The present invention further relates to a method for manufacturing a cut article with this cutting tool.

BACKGROUND

Cemented carbides (WC-base sintered alloys) are known as alloys for cutting tool materials or wear-resistant tool materials. However, the cutting tools of the cemented carbides are easily worn at rake faces by cutting steel. In order to solve this problem, cermet alloys have been developed. For example, TiC-base cermets containing TiC as main components have been developed, however, these materials are insufficient in toughness, and therefore TiCN-base cermets further containing TiN are widely used.

It is known that modifying the hard particle in the TiCN-base cermets into a core-containing structure particle having a core and a shell can improve the hardness and the toughness of the TiCN-base cermets. The hard particle has most influence on the mechanical property of the TiCN-base cermets (see Japanese Unexamined Patent Application Publication No. 2-254131, and Japanese Unexamined Patent Application Publication No. 10-287946 etc.). The contents of these publications are incorporated herein by reference in their entirety.

Japanese Unexamined Patent Application Publication No. 3-170637 discloses a cermet which includes hard particles having cores and shells composed of carbonitrides of metals (hard metals) belonging to group IVa, Va, or VIa of the periodic table. The hard particles include plural kinds of core-containing structure particles which have cores and/or shells composed of plural kinds of the hard metals. The cermet can improve the defect resistance (toughness) without a decrease in wear resistance (cutting resistance). The contents of this publication are incorporated herein by reference in their entirety.

Japanese Unexamined Patent Application Publication No. 11-229068 discloses that sintering properties can be improved by dispersing superfine alloy particles composed of a binding metal made of Co and/or Ni in hard particles having a core-containing structure, and thereby even cermets having a small binding phase can be densified. The contents of this publication are incorporated herein by reference in their entirety.

However, hard particles having a core-containing structure, such as those disclosed in Japanese Unexamined Patent Application Publications No. 2-254131 and No. 10-287946, have limitation in improvement of mechanical properties and cutting performance. In particular, TiCN-base cermets whose thermal shock resistance and chipping resistance are equal to those of a WC-base sintered alloy provided with a hard coating film on the surface have been desired.

In the particles having a plurality of core-containing structures whose cores and shells have different compositions each other, as those disclosed in Japanese Unexamined Patent Application Publication No. 3-170637, since the hard particles consist of only hard metals such as carbonitride, the thermal conductivity of a cermet is low. Therefore, generated heat in a cutting edge due to cutting cannot be efficiently dissipated. As a result, disadvantageously, the temperature of the cutting edge increases and thermal shock resistance and chipping resistance decreases.

Furthermore, as in Japanese Unexamined Patent Application Publication No. 3-170637, dispersing superfine alloy particles made of a binding metal in hard particles improves the sintering properties of the cermet. However, a binding metal having a low hardness is present in the form of particles. Besides, the binding phase is originally in a low proportion and has a low binding force. Therefore, the strength of the sinter decreases and the binding metal particles may cause breakage or chipping.

SUMMARY

According to one aspect of the invention, a cermet comprises a binding phase made of a binding metal including Co and/or Ni. The binding phase is 5 to 30 mass %. The cermet also comprises a plurality of hard particles bound each other with the binding phase. A part of the hard particles comprises core-containing structure particles having cores and shells both including TiCN. The core-containing structure particles comprise first core-containing structure particles of which shells contain the binding metal and second core-containing structure particles of which cores and shells both contain the binding metal.

According to another aspect of the invention, a cutting tool comprises a rake face; a flank face; and a cutting edge comprising the cermet. The cutting edge is formed in a cross-ridge portion between the rake face and the flank face.

According to another aspect of the invention, a method for manufacturing a cut article with a cutting tool comprises preparing an article and a cutting tool which comprises the cermet. The method further comprises putting the cutting edge to the article to obtain the cut article.

According to another aspect of the invention, a cermet comprises a binding phase made of a binding metal including Co and/or Ni. The binding phase being 5 to 30 mass %. The cermet further comprises a plurality of hard particles bound each other with the binding phase. The hard particles comprise core-containing structure particles having cores and shells both including TiCN and the binding metal.

BRIEF DESCRIPTION OF THE DRAWING(S)

DETAILED DESCRIPTION OF THE PREFERRED EMBODIMENT(S)

The present inventors have conducted intensive studies for solving the above-mentioned problems of the related arts and have found the fact that the following cermet can maintain a high hardness and a high toughness thereof, and can improve the thermal shock resistance and the chipping resistance thereof. The cermet comprises a binding metal phase composed of Co and/or Ni, and hard particles bound with the binding metal phase. The hard particles have the core-containing structure particles which have cores and shells, both of which include TiCN. The core-containing structure particles include first core-containing structure particles of which shells contain the binding metal and second core-containing structure particles of which cores and shells both contain the binding metal.

When the content ratio of the binding metal in the core of the second core-containing structure particles is from 0.5 mass % to 5 mass %, the chipping resistance of the cermet can be enhanced without the major deterioration of wear resistance even though the cermet does not comprises the first core-containing structure the wear resistance of cermet.

TiCN-Base Cermet

Figure 1A:
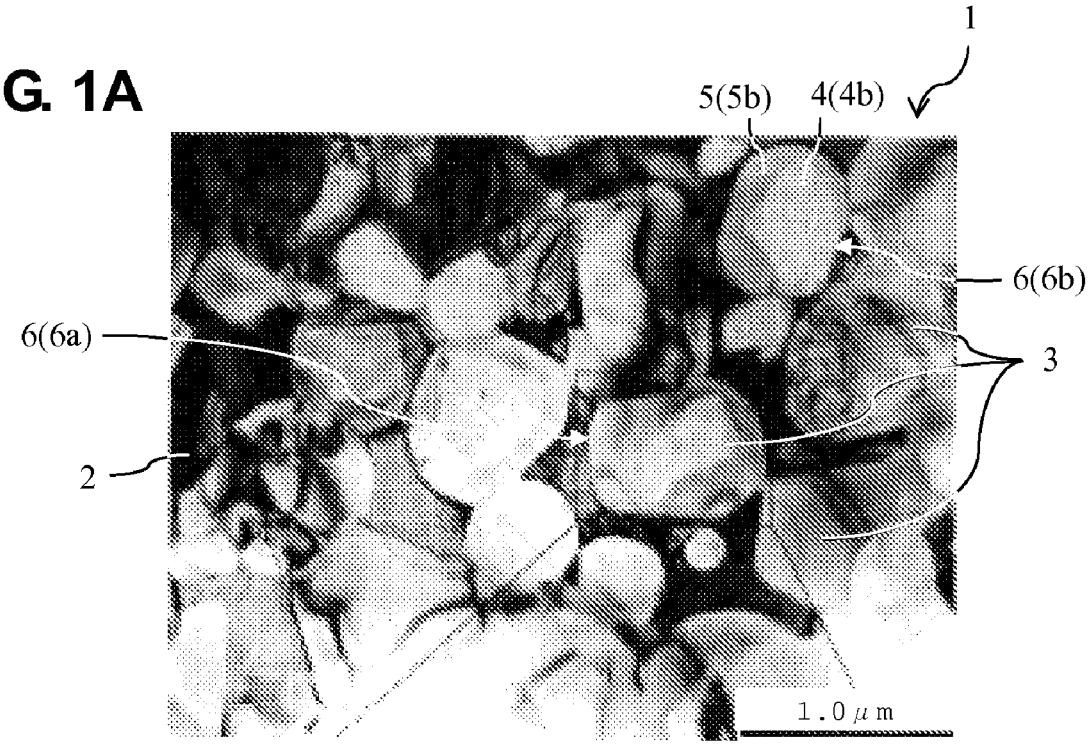
FIG. 1(*a*) is an enlarged image of a cross-sectional structure of a TiCN-base cermet according to an embodiment of the present invention, obtained using a transmission electron microscope (TEM), and FIG. 1(*b*) is an enlarged image of a first core-containing structure particle of the cermet in FIG. 1(*a*).
Figure 1B:
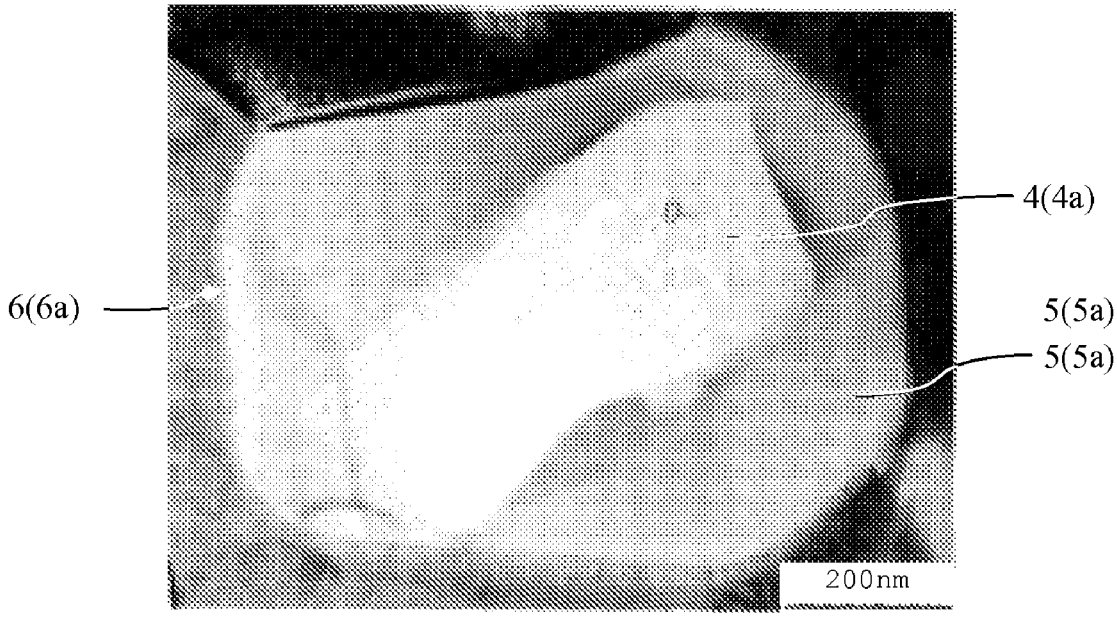

A TiCN-base cermet (hereinafter simply referred to as "cermet") according to an embodiment of the present invention will now be described in detail with reference to the drawings. FIG. 1(*a*) is an enlarged image of the cross-sectional structure of any cross-section of a cermet according to an embodiment of the present invention, obtained using a transmission electron microscope (TEM), and FIG. 1(*b*) is an enlarged image of a first core-containing structure particle of the cermet in FIG. 1(*a*).

As shown in FIG. 1(*a*), the cermet 1 according to this embodiment comprises the binding phase 2 and hard particles 3 bound with the binding phase 2. The binding phase 2 comprises a Co and/or Ni binding metal and is present in an amount of 5 to 30 mass % based on the total amount of the cermet 1. When the content of the binding phase 2 is lower than 5 mass %, the toughness is decreased and thereby the chipping resistance is decreased. When the content of the binding phase 2 is higher than 30 mass %, the wear resistance and the plastic deformation resistance of the cermet 1 are decreased.

The observation of a cross-sectional structure by a microscope, as shown in FIG. 1(*a*), shows that a part of the hard particles 3 includes core-containing structure particles 6 which have a structure composed of a core 4 and a shell 5 both comprising TiCN.

Since the hard particles 3 constituting the core-containing structure particles 6 have a grain-growth-inhibiting effect, the cermet 1 can have a fine and uniform structure. In addition, the excellent wettability of the hard particles 3 with the binding phase 2 also contributes to the enhancement of strength of the cermet 1.

As shown in FIGS. 1(*a*) and 1(*b*), the core-containing structure particles 6 include first core-containing structure particles 6*a* of which shells 6*a* contain the binding metal (Co and/or Ni) and second core-containing structure particles 6*b* of which cores 4*b* and shells 5*b* both contain the binding metal. Core-containing structure particles 6 including these two types of core-containing structure particles 6*a* and 6*b* can enhance the thermal conductivity efficiency while maintaining high hardness and high toughness of the hard particles 3. Therefore, locally generated heat can be quickly dissipated and, as a result, thermal shock resistance and chipping resistance of the cermet 1 are improved.

When the core-containing structure particles 6 do not include both such designated core-containing structure particles 6*a* and 6*b*, the locally generated heat is hard to be not quickly dissipated, and also the toughness of the cermet 1 becomes insufficient or the hardness of the cermet 1 is reduced. Therefore, the thermal shock resistance, chipping resistance, and wear resistance of the cermet 1 cannot be sufficiently enhanced. Consequently, for example, a cutting tool made of such a cermet 1 has a short tool life.

When the content ratio of the bound metal in the core 4*b* of the second core-containing structure particles is from 0.5 mass % to 5 mass %, the chipping resistance of the cermet 1 can be enhanced without the major deterioration of wear resistance even though the cermet 1 does not comprises the first core-containing structure the wear resistance of cermet 1.

The core-containing structure particles 6 include both the first core-containing structure particles 6*a* and the second core-containing structure particles 6*b*. This means that the first core-containing structure particles 6*a* and the second core-containing structure particles 6*b*, these two types of particles, are independently present (coexist) among the core-containing structure particles 6. The presence of the core-containing structure particles 6*a* and 6*b* and their compositions can be measured by cross-sectional structure observation using a transmission electron microscope (TEM) and then by energy dispersive X-ray spectroscopy (EDS) analysis as described below, for example.

In particular, it is preferred that the first core-containing structure particle 6*a* comprises a core 4*a* including TiCN and a shell 5*a* including a complex carbonitride of Ti and at least one element selected from the group consisting of Ta, Nb, W, Zr, and Mo. The shell 5*a* also includes the binding metal. It is preferred that the second core-containing structure particle 6*b* comprises a core 4*b* including TiCN and the binding metal. The second core-containing structure particle 6*b* comprises a shell 5*b* including a complex carbonitride of Ti and at least one element selected from the group consisting of Ta, Nb, W, Zr, and Mo. When the core-containing structure particles 6*a* and 6*b* have such structures, the thermal shock resistance, the chipping resistance, and the wear resistance of the cermet 1 are further enhanced.

The proportion $p_1/(p_1+p_2)$ where a presence ratio $p_1$ is the ratio of the first core-containing structure particles 6*a* to all the core-containing structure particles and a presence ratio $p_2$ is the ratio of the second core-containing structure particles 6*b* to all the core-containing structure particles is preferably 0.3 to 0.7. With such a proportion, both high hardness and high toughness of the cermet 1 can be maintained.

The average particle diameter of the hard particles 3 is preferably 1.5 μm or less. With such a particle diameter, the hardness of the cermet 1 can be increased. The lower limit of the average particle diameter is preferably 0.4 μm or more in view of effective prevention of a decrease in resistance to chipping caused by significant fineness of particles. The average particle diameter is a value obtained by analyzing the hard particles 3 using a Luzex image analyzer in observation of a cross-sectional structure of the cermet 1 using a microscope.

It is preferred that the cores 4*b* of the second core-containing structure particles 6*b* contain 94 to 99.5 mass % of Ti and 0.5 to 6 mass % in total of Co and/or Ni. With such cores, the thermal shock resistance of the cermet 1 can be enhanced while the high hardness of the cermet 1 is maintained. Each amount of Ti, Co, and Ni is an amount of each element which exists as a metal element.

Furthermore, it is preferred that the shells 6*a* and 6*b* of the first core-containing structure particles 6*a* and the second core-containing structure particles 6*b* each contain 40 to 80 mass % of Ti, 15 to 59 mass % in total of at least one element selected from the group consisting of Ta, Nb, W, Zr, and Mo, and 1 to 5 mass % in total of Co and/or Ni. With such shells, the cermet 1 can have high toughness and the thermal shock resistance, and the chipping resistance of the cermet 1 can be enhanced. Each amount of Ti, Ta, Nb, W, Zr, Mo, Co, and Ni is an amount of each element which exists as a metal element.

Similarly as above, compositions and composition ratios of the cores 4*a* and 4*b* and the shells 5*a* and 5*b* can be measured by cross-sectional structure observation using a transmission electron microscope (TEM) and then by energy dispersive X-ray spectroscopy (EDS) analysis.

In addition to the first core-containing structure particles 6*a* and the second core-containing structure particles 6*b*, the cermet 1 may further include a non-core-containing structure particles to the extent that a cross-section observed through the microscope include 30 area % or less of non-core-containing structure particles based on the total area of the hard particles 3. Furthermore, aggregation of the binding metal may be present in the core-containing structure particles 6.

It is desirable that the carbon content of the cermet 1 be 6 to 9 mass %, particularly 6.5 to 7.5 mass %, in view of achieving satisfactory hardness and thermal shock resistance and favorable surface conditions.

Manufacturing Process

Next, a method for manufacturing the above-described cermet 1 will be described. First, powdery raw materials are prepared and mixed. Specifically, it is preferred that both a usual TiCN powder and a Co/Ni-doped TiCN powder, which is prepared by previously adding a binding metal of Co and/or Ni to the TiCN powder, be used. Then, a powder mixture is prepared by mixing these powders; a TiN powder; at least one powder of carbides, nitrides, and carbonitrides which contain one or more metal elements selected from the group consisting of W, Mo, Ta, V, and Nb; and a Co powder and/or Ni powder.

It is desirable that the usual TiCN powder have an average particle diameter (by microtrac analysis) of 2 μm or less, particularly 0.05 to 1.5 μm, and the Co/Ni-doped TiCN powder have an average particle diameter of 2 μm or less, particularly 0.05 to 1.5 μm, from the viewpoint that the above-described two types core-containing structures 6*a* and 6*b* can be prepared with high reproducibility.

Furthermore, it is desirable that the Co powder and/or Ni powder have an average particle diameter of 2 μm or less, particularly 0.05 to 1.5 μm, for enhancing sintering properties of the cermet 1. The use of a solid solution powder containing Co and Ni at predetermined ratios as the binding-metal powdery raw material is further desirable in view of further enhancing the sintering properties. It is desirable that the average particle diameters of other powdery materials be 0.05 to 3 μm.

The average particle diameter of each of the above-mentioned powder and powdery materials is measured by a micro-track method.

After addition of a binder to this powder mixture, the powder mixture is formed into a predetermined shape by a known process such as press molding, extrusion molding, or injection molding and is then fired. The preferable conditions for the firing are, for example, the following (a) to (d): the temperature is (a) increased from a first firing temperature to 1300° C. at a heating rate of 0.1 to 3° C./min; then (b) from 1300° C. to a second firing temperature of 1400 to 1600° C. at a heating rate of 5 to 15° C./min under an atmosphere of a nitrogen partial pressure of 0 to 135 Pa; (c) maintained, and (d) then decreased.

Cutting Tool

The above-described cermet 1 according to this embodiment exhibits excellent thermal shock resistance and chipping resistance. The cermet 1 is applicable to various tools such as cutting tools, mining tools, and blades. In particular, the above-described excellent performance of the cermet can be exhibited in cutting tools.

Figure 2:
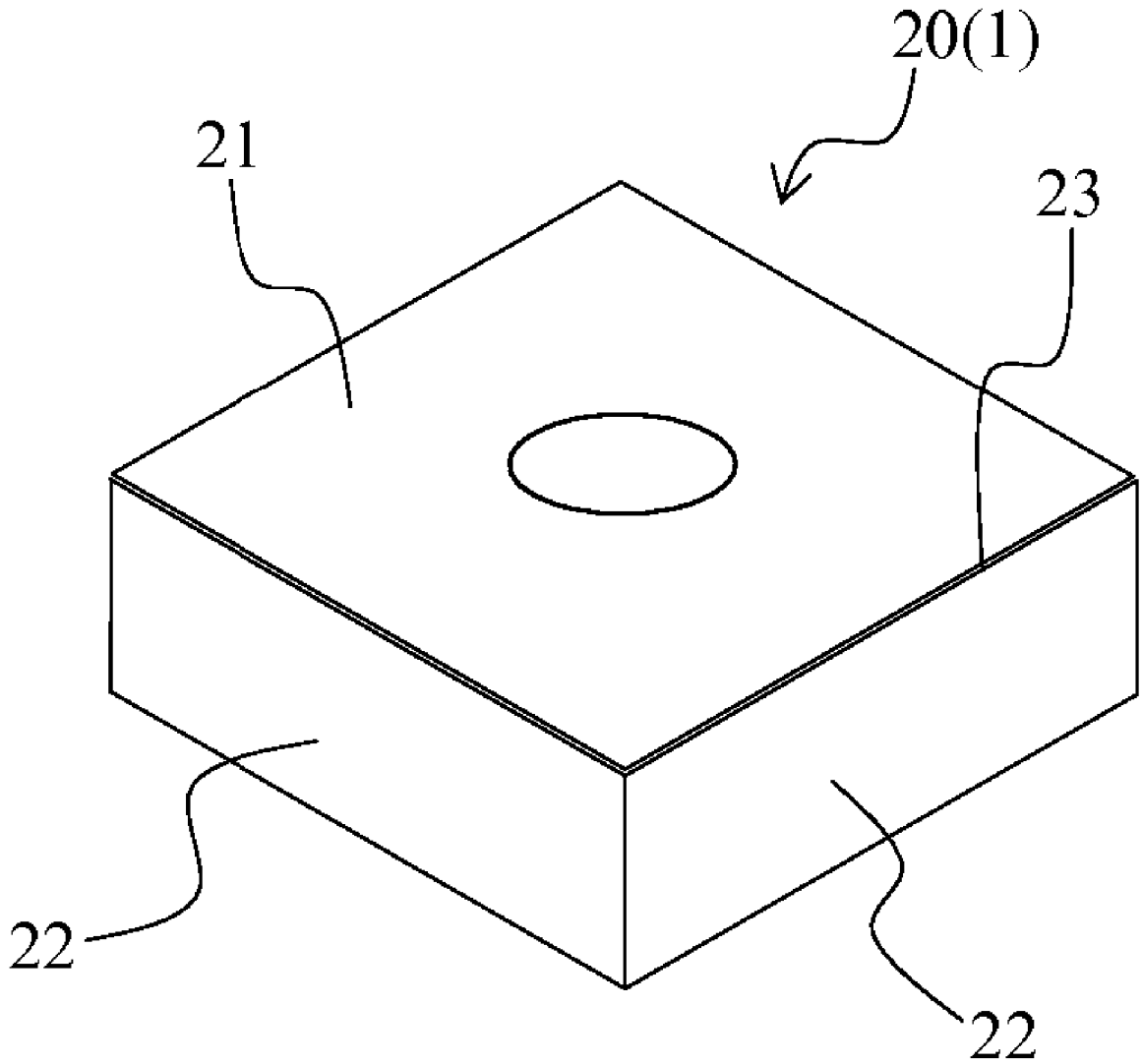
FIG. 2 is a schematic diagram illustrating a cutting tool according to an embodiment of the present invention.

The cutting tool is preferably, for example, as illustrated in FIG. 2, a cutting tool 20 of the cermet 1 and having a cutting edge 23 formed at a cross-ridge portion between a rake face 21 and a flank face 22 and is used for cutting an article by applying the cutting edge 23 to the article. Such a cutting tool 20 can have a long tool life by applying the cutting edge 23 of the cutting tool 20 to a metal such as iron and aluminum or a heat-resistant alloy. Furthermore, the cutting tool can also exhibit excellent cutting properties in cutting an article which is difficult to be cut, such as highly hardened steel.

The cermet 1 can also have excellent mechanical confidence in applications other than the cutting tool, for example, in wear-resistant members such as a mold, mill roll, die, and guide; a blade; and bearings.

The present invention will now be described in detail with reference to Examples, but is not limited to the following Examples.

EXAMPLES

TiCN powder, TiCN powder doped with 10 mass % of Co, TiN powder, ZrC powder, VC powder, TaC powder, NbC powder, WC powder, MoC powder, Ni powder, Co powder, and solid solution powder of Ni and Co having average particle diameters shown in Tables 1 and 2 were prepared and these powders were blended so as to have compositions shown in Tables 1 and 2.

Then, each of the blends was wet mixed in isopropyl alcohol (IPA) using a stainless steel ball mill and a cemented carbide ball, and 3 mass % of paraffin was added thereto. The resulting mixture was further mixed. Then, the powder mixture was press-formed into a throw-away tip shape of ISO CNMG120408 at 200 MPa and was then fired under conditions shown in Tables 1 and 2 to obtain a sinter (Sample Nos. 1 to 10 in Table 1, Sample Nos. 11 and 12 in Table 2).

In sample No. 5 in Table 1, sources of Co and Ni were a solid solution powder containing Ni and Co (Ni: 5 mass %, Co: 6.5 mass %) and a Ni powder (5 mass

TABLE 1

| | Composition (mass %), numerals in parentheses denote ratios of solid solution components (average particle diameter (μm) of powdery raw material) | | | | | | | | | | Firing conditions | | | |
|---|---|---|---|---|---|---|---|---|---|---|---|---|---|---|
| Sample No. | TiCN | TiCN + 10 mass % of Co | TiN | TaC | NbC | WC | ZrC | VC | Ni | Co | First firing temperature (° C.) | Heating rate I[1)] | Second firing temperature (° C.) | Heating rate II[2)] |
| 1 | 22.5 (0.7) | 25 (1.0) | 13 (2.0) | — | — | 20 (1.0) | 3 (2.5) | — | 7(7) | 9.5(9.5) (1.0) | 1000 | 0.3 | 1500 | 10 |
| 2 | 11 (1.5) | 10 (1.0) | 35 (2.0) | 5 (2.0) | 10 (2.0) | 7 (1.0) | 3 (2.5) | — | 10(10) | 9(9) (1.0) | 900 | 0.3 | 1450 | 13 |
| 3 | 11 (0.7) | 10 (1.0) | 30 (2.0) | 9 (2.0) | 10 (2.0) | 13 (1.0) | — | — | 3(3) | 14(14) (1.0) | 1000 | 0.5 | 1550 | 8 |

TABLE 1-continued

| Sample No. | Composition (mass %), numerals in parentheses denote ratios of solid solution components (average particle diameter (μm) of powdery raw material) | | | | | | | | | | Firing conditions | | | |
|---|---|---|---|---|---|---|---|---|---|---|---|---|---|---|
| | TiCN | TiCN + 10 mass % of Co | TiN | TaC | NbC | WC | ZrC | VC | Ni | Co | First firing temperature (° C.) | Heating rate I[1)] | Second firing temperature (° C.) | Heating rate II[2)] |
| 4 | 22 (0.7) | 20 (0.7) | 20 (2.0) | — | — | 20 (1.0) | 2 (2.5) | — | 8(8) (1.0) | 8(8) | 1100 | 1 | 1570 | 5 |
| 5 | 16.5 (0.7) | 15 (1.0) | 30 (2.0) | — | 20 (2.0) | — | — | 2 (1.0) | 10(5) (1.5(Ni)) (1.0(Co/Ni)) | 6.5(6.5) | 850 | 2 | 1525 | 8 |
| 6 | 17 (0.7) | 20 (1.0) | 20 (2.0) | — | 5 (2.0) | 20 (1.0) | — | — | 10 (1.5) | 8 (1.0) | 950 | 2.5 | 1530 | 12 |
| 7 | 26.5 (0.7) | 15 (1.0) | 12 (2.0) | 10 (2.0) | 10 (2.0) | 10 (1.0) | — | — | 8 (1.5) | 8.5 (1.0) | 1050 | 3 | 1600 | 7 |
| * 8 | 30 (0.7) | — | 30 (2.0) | 5 (2.0) | 10 (2.0) | 10 (1.0) | — | 2 (1.0) | 6 (1.5) | 7 (1.0) | 1200 | 0.2 | 1500 | 6 |
| * 9 | 15 (0.7) | 10 (1.0) | 30 (2.0) | 10 (2.0) | 5 (2.0) | 15 (1.0) | 3 (2.5) | — | 6 (1.5) | 6 (1.0) | — | — | 1600 | 3 |
| * 10 | 10 (0.7) | 10 (1.0) | 25 (2.0) | 20 (2.0) | 5 (2.0) | 5 (1.0) | 3 (2.5) | 5 (1.0) | 7 (1.5) | 10 (1.0) | 1000 | 5 | 1450 | 16 |

The mark "*" means the sample which is outside the range of the present invention.
[1)]Heating rate I: heating rate (° C./min) in the range of from the first firing temperature to 1300° C.
[2)]Heating rate II: heating rate (° C./min) in the range of from 1300° C. to the second firing temperature

TABLE 2

| Sample No. | Composition (mass %), numerals in parentheses denote ratios of solid solution components (average particle diameter (μm) of powdery raw material) | | | | | | | | | | Firing conditions | | | |
|---|---|---|---|---|---|---|---|---|---|---|---|---|---|---|
| | TiCN | TiCN + 10 mass % of Co | TiN | TaC | NbC | WC | ZrC | MoC | Ni | Co | First firing temperature (° C.) | Heating rate I[1)] | Second firing temperature (° C.) | Heating rate II[2)] |
| 11 | 32 (0.7) | 18 (1.0) | 10 (2.0) | — | 5 (2.0) | 20 (1.0) | | 2 (2.5) | 5 (1.5) | 10 (1.0) | 1050 | 1 | 1575 | 3 |
| 12 | 30 (0.7) | 10 (1.0) | 10 (2.0) | 5 (2.0) | 10 (2.0) | 7 (1.0) | 3 (2.5) | — | 5 (1.5) | 10 (1.0) | 1000 | 5 | 1450 | 7 |

[1)]Heating rate I: heating rate (° C./min) in the range of from the first firing temperature to 1300° C.
[2)]Heating rate II: heating rate (° C./min) in the range of from 1300° C. to the second firing temperature The surface of the resulting sinter was machined with a diamond whetstone, and cutting properties were evaluated under conditions below. The core-containing structure particles of each sample were observed using a transmission electron microscope (TEM) and using analysis by energy dispersive X-ray spectroscopy (EDS) for confirming the presence of the first core-containing structure particles and the second core-containing structure particles, for confirming composition ratios of the cores and the shells. The results are shown in Table 3.

Furthermore, cutting was performed using the resulting throw-away tips under the following conditions, and performances as cutting tools were evaluated.

(Cutting Condition)
Cutting speed: 300 m/min
Feed: 0.25 to 0.40 mm/rev (+0.05 mm/rev)
Depth of cut: 2.0 mm
Article: SCM435, 5 mm×4 grooves
Cutting time: 60 sec (cutting time at each feed)
Cutting conditions: wet (emulsion)

TABLE 3

| Sample No. | Composition (mass %) of hard particle | | | | | | | | | | Cutting life (sec) |
|---|---|---|---|---|---|---|---|---|---|---|---|
| | First core-containing structure particle | | | | Second core-containing structure particle | | | | | | |
| | | Shell composition | | | | Core | | Shell composition | | | |
| | Existence | Ti | Co + Ni | Metal element constituting complex carbonitride | Existence | Ti | Co + Ni | Ti | Co + Ni | Metal element constituting complex carbonitride | |
| 1 | Presence | 60 | 2 | W35, Zr3 | Presence | 98.5 | 1.5 | 65 | 2 | W31, Zr2 | 295 |
| 2 | Presence | 46.5 | 1.5 | Nb20, W15, Ta10, Zr7 | Presence | 97.4 | 2.6 | 47 | 2 | Nb20, W15, Ta12, Zr4 | 216 |
| 3 | Presence | 51 | 1 | W20, Nb15, Ta13 | Presence | 98.2 | 1.8 | 55 | 1 | W17, Nb15, Ta12 | 223 |
| 4 | Presence | 63 | 2 | W32, Zr3 | Presence | 98.3 | 1.7 | 65.8 | 2.2 | W30, Zr2 | 292 |
| 5 | Presence | 65.8 | 1.2 | Nb30, V3 | Presence | 97.5 | 2.5 | 63.1 | 1.4 | Nb32, V3.5 | 215 |
| 6 | Presence | 69.9 | 2.1 | W20, Nb8 | Presence | 97.9 | 2.1 | 66 | 2.3 | W26.7, Nb5 | 210 |
| 7 | Presence | 47.2 | 1.8 | W15, Nb18, Ta18 | Presence | 98.2 | 1.8 | 49.5 | 1.5 | W16, Nb22, Ta11 | 145 |

TABLE 3-continued

| Sample | Composition (mass %) of hard particle | | | | | | | | | | Cutting |
|---|---|---|---|---|---|---|---|---|---|---|---|
| | First core-containing structure particle | | | | Second core-containing structure particle | | | | | | |
| | | Shell composition | | | | Core | | Shell composition | | | |
| No. | Existence | Ti | Co + Ni | Metal element constituting complex carbonitride | Existence | Ti | Co + Ni | Ti | Co + Ni | Metal element constituting complex carbonitride | life (sec) |
| * 8 | Presence | 46 | 1 | W18, Nb22, Ta10, V3 | Absence | | | | — | | 53 |
| * 9 | Absence | | | — | Presence | 94.1 | 5.9 | 40.2 | 1.8 | W30, Nb15, Ta13 | 44 |
| * 10 | Absence | | | — | Presence | 93.8 | 6.2 | 51.5 | 1.5 | Ta20, Nb10, W5, Zr5, V7 | 42 |
| * 11 | Absence | | | — | Presence | 97.9 | 2.1 | 65 | 2.5 | W28, Nb2.5, Mo2 | 120 |
| * 12 | Absence | | | — | Presence | 85.2 | 4.8 | 40.3 | 1.8 | W35, Nb21, Ta1.4 | 110 |

The mark "*" means that the sample is outside the range of the present invention.

As obvious from the results shown in Table 3, samples Nos. 1 to 7, which were fired under prescribed conditions and were confirmed to have two types of core-containing structure particles, i.e., first core-containing structure particles and second core-containing structure particles, as the hard particles, had cutting lives longer than those of comparative samples Nos. 8 to 10.

In addition, the machined faces of cut articles (SCM435) machined with throw-away tips of samples Nos. 1 to 7 were glossy, and stable cutting machining was achieved. On the other hand, the machined faces of cut articles machined with throw-away tips of samples Nos. 8 to 10 were clouded and not glossy.

Furthermore, samples Nos. 11 and 12 had cutting lives longer than those of comparative samples Nos. 8 to 10.

What is claimed is:

1. A cermet comprising, a binding phase made of a binding metal including Co and/or Ni, the binding phase being 5 to 30 mass %; and a plurality of hard particles bound each other with the binding phase, a part of the hard particles comprising core-containing structure particles having cores and shells both including TiCN; wherein the core-containing structure particles comprise first core-containing structure particles of which shells contain the binding metal and cores do not contain the binding metal, and second core-containing structure particles of which cores and shells both contain the binding metal.

2. The cermet according to claim 1, wherein the shells of the first core-containing structure particles further contain at least one element selected from the group consisting of Ta, Nb, W, Zr, and Mo; and the shells of the second core-containing structure particles further contain at least one element selected from the group consisting of Ta, Nb, W, Zr, and Mo.

3. The cermet according to claim 1, wherein the proportion $p_1/(p_{1+P2})$ is from 0.3 to 0.7 wherein pi is the presence ratio of the first core-containing structure particles to all the core containing structure particles and $p_2$ is the presence ratio of the second core-containing structure particles to all the core containing structure particles.

4. The cermet according to claim 1, wherein the hard particles have an average particle diameter of 1.5 μm or less.

5. The cermet according to claim 2, wherein the cores of the second core-containing structure particles contain 94 to 99.5 mass % of Ti and 0.5 to 6 mass % in total of Co and/or Ni.

6. The cermet according to claim 2, wherein the shells of the first core-containing structure particles and the second core-containing structure particles contain 40 to 80 mass % of Ti, 15 to 59 mass % in total of at least one element selected from the group consisting of Ta, Nb, W, Zr, and Mo, and 1 to 5 mass % in total of Co and/or Ni.

7. A cutting tool comprising:

a rake face;

a flank face; and a cutting edge comprising the cermet according to claim 1, formed in a cross-ridge portion between the rake face and the flank face.

8. A method for manufacturing a cut article using a cutting tool, comprising:

preparing an article and the cutting tool according to claim 7; and putting the cutting edge to the article to obtain the cut article.

9. A cermet comprising, a binding phase made of a binding metal including Co and/or Ni, the binding phase being 5 to 30 mass %; and a plurality of hard particles bound each other with the binding phase, the hard particles comprising core-containing structure particles having cores and shells both including TiCN;

wherein the core-containing structure particles comprise first core-containing structure particles of which shells contain the binding metal and cores do not contain the binding metal, and second core-containing structure particles of which cores and shells both contain the binding metal.

10. The cermet according to claim 1, wherein the cores of the first core-containing particles are composed of TiCN, and the shells of the first core-containing particles are composed of the binding metal and a complex carbonitride of Ti and at least one element selected from the group consisting of Ta, Nb, W, Zr, and Mo; and the cores of the second core-containing particles are composed of TiCN and the binding metal, and the shells of the second core-containing particles are composed of the binding metal and a complex carbonitride of Ti and at least one element selected from the group consisting of Ta, Nb, W, Zr, and Mo.

* * * * *